US005626379A

United States Patent [19]

Scott

[11] Patent Number: 5,626,379

[45] Date of Patent: May 6, 1997

[54] PORTABLE GUN RACK

[76] Inventor: Barry Scott, 41162 Montelimar Ct., Murrietta, Calif. 92562

[21] Appl. No.: 509,230

[22] Filed: Jul. 31, 1995

[51] Int. Cl.[6] ..... A45F 5/00; A47B 43/00

[52] U.S. Cl. ..... 294/143; 294/159; 211/64; 211/195; 248/171

[58] Field of Search ..... 294/143, 145, 294/146, 159, 163; 211/64, 195, 203; 248/96, 169, 171; 224/913

[56] References Cited

U.S. PATENT DOCUMENTS

| | | | |
|---|---|---|---|
| D. 162,207 | 2/1951 | Mettenleiter | 211/64 |
| 1,621,329 | 3/1927 | Malone | 294/143 |
| 2,251,271 | 8/1941 | Del Campo, Jr. | 211/64 |
| 2,590,154 | 3/1952 | Burns | 294/143 |
| 4,181,221 | 1/1980 | Tennant | 211/84 |
| 4,271,969 | 6/1981 | Gnesa | 211/64 |
| 4,620,682 | 11/1986 | Yim | 248/96 |
| 5,147,089 | 9/1992 | Anderson | 248/96 |
| 5,154,377 | 10/1992 | Suk | 248/96 |

*Primary Examiner*—Dean Kramer
*Attorney, Agent, or Firm*—Edgar W. Averill, Jr.

[57] ABSTRACT

A portable gun rack for transporting and supporting at least one firearm such as a shotgun or rifle. The portable gun rack has a butt support shelf with recesses to support the butt of the gun or guns being transported and a barrel support arm to support the barrels of guns being carried. A handle is located along the frame of the gun rack. A pair of legs are automatically pivoted outwardly as the gun rack is rested on the ground. In this way, guns not being used can be safely and cleanly supported on the portable gun rack.

7 Claims, 3 Drawing Sheets

21
2
19
19
14
19
19
18
20
11
10
13
24
38
40
39
37
22
12
25
33
17
23
17
26
34
17
2
16

Fig. 3
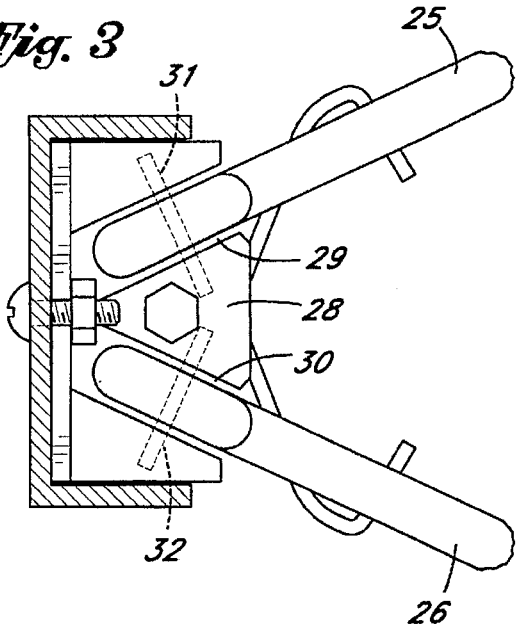
Fig. 4
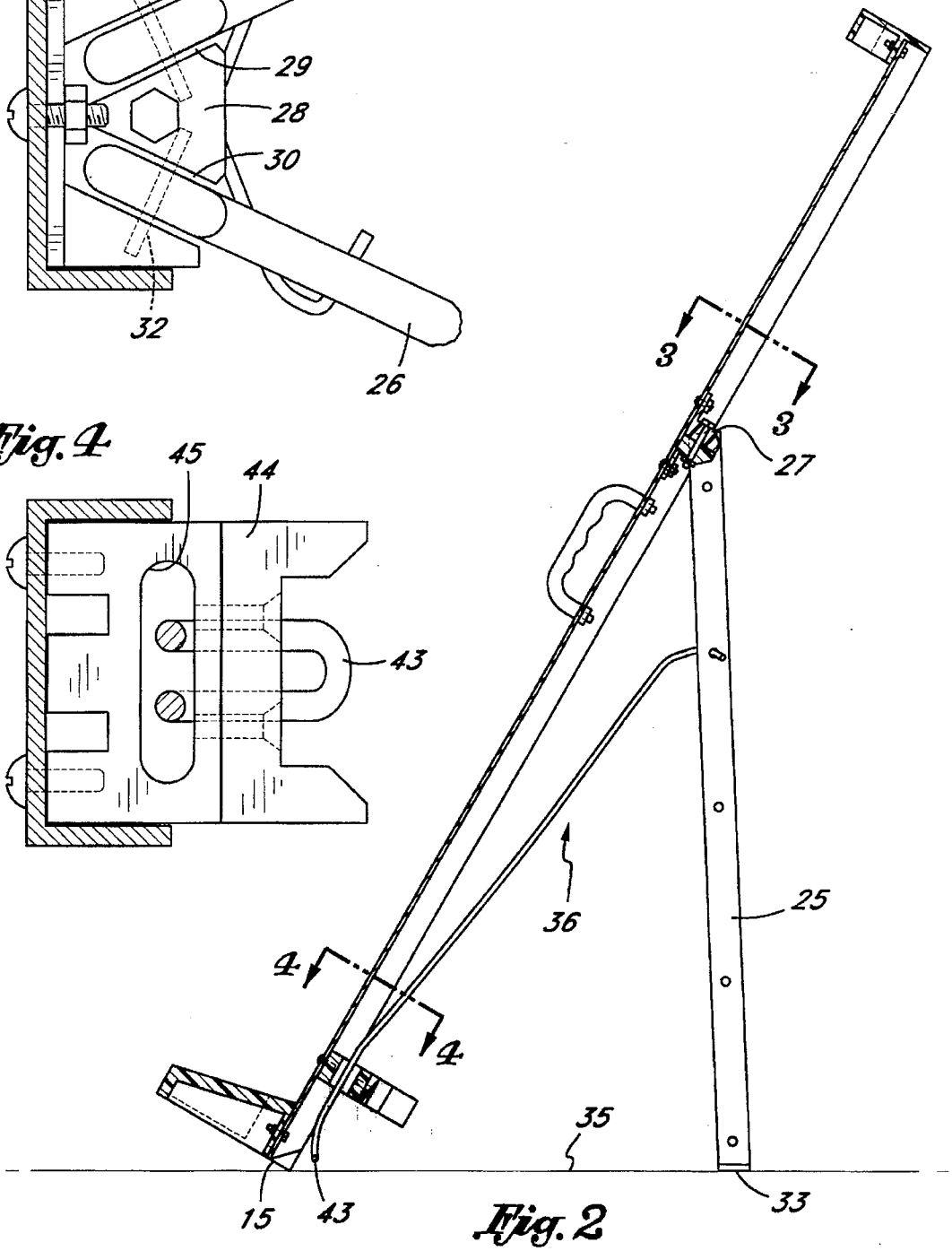
Fig. 2

PORTABLE GUN RACK

BACKGROUND OF THE INVENTION

The field of the invention is sporting goods and the invention relates more particularly to firearms and still more particularly to shotguns and rifles.

It is common for shotguns and rifles to be carried in a canvas or leather bag which maintains the firearm in a clean and safe environment. Such gun cases, however, are cumbersome to open for removal of a firearm or to replace a firearm therein. Thus, if the user wishes to practice with several different firearms, it is not convenient to remove one firearm while replacing another firearm. Also, in many locations the gun case can become soiled if placed on the ground.

The classic approach to such portable gun rack is to use a spike such as that shown in U.S. Pat. No. 3,952,878 where several guns can be supported on a rack which has been driven into the ground. Another such rack is shown in U.S. Pat. No. 4,271,969. Other portable gun racks are free-standing such as that shown in design U.S. Pat. No. 162,207 or utility U.S. Pat. No. 2,251,271. Tripod stands for golf bags are well known and such stands are shown in U.S. Pat. Nos. 1,752,114, 2,751,176, 4,620,682, 4,798,357 and 5,156,366. Such technology has never been applied to a portable gun rack.

SUMMARY OF THE INVENTIONS

It is an object of the present invention to provide a portable gun rack for transporting and supporting several firearms such as shotguns or rifles. The portable gun rack has an elongated rack frame which has a butt support shelf held near the bottom and a barrel support arm held near the top. The frame preferably has a carrying handle and first and second legs pivotally held along the frame. The legs are moved from a closed position where they lie adjacent the frame to an open position where they are pivoted outwardly from the frame. Leg actuating means move the legs from a closed position to an open position and an actuating foot extends from the bottom of the gun rack. When the foot is rested against the ground the legs are pivoted outwardly to provide a stand for the portable gun rack.

BRIEF DESCRIPTION OF THE DRAWINGS

FIG. 2 is a cross-sectional view taken along line 2—2 of FIG. 1.

FIG. 3 is a cross-sectional view taken along line 3—3 of FIG. 2.

FIG. 4 is a cross-sectional view taken along line 4—4 of FIG. 2.

DESCRIPTION OF THE PREFERRED EMBODIMENTS

Figure 1:
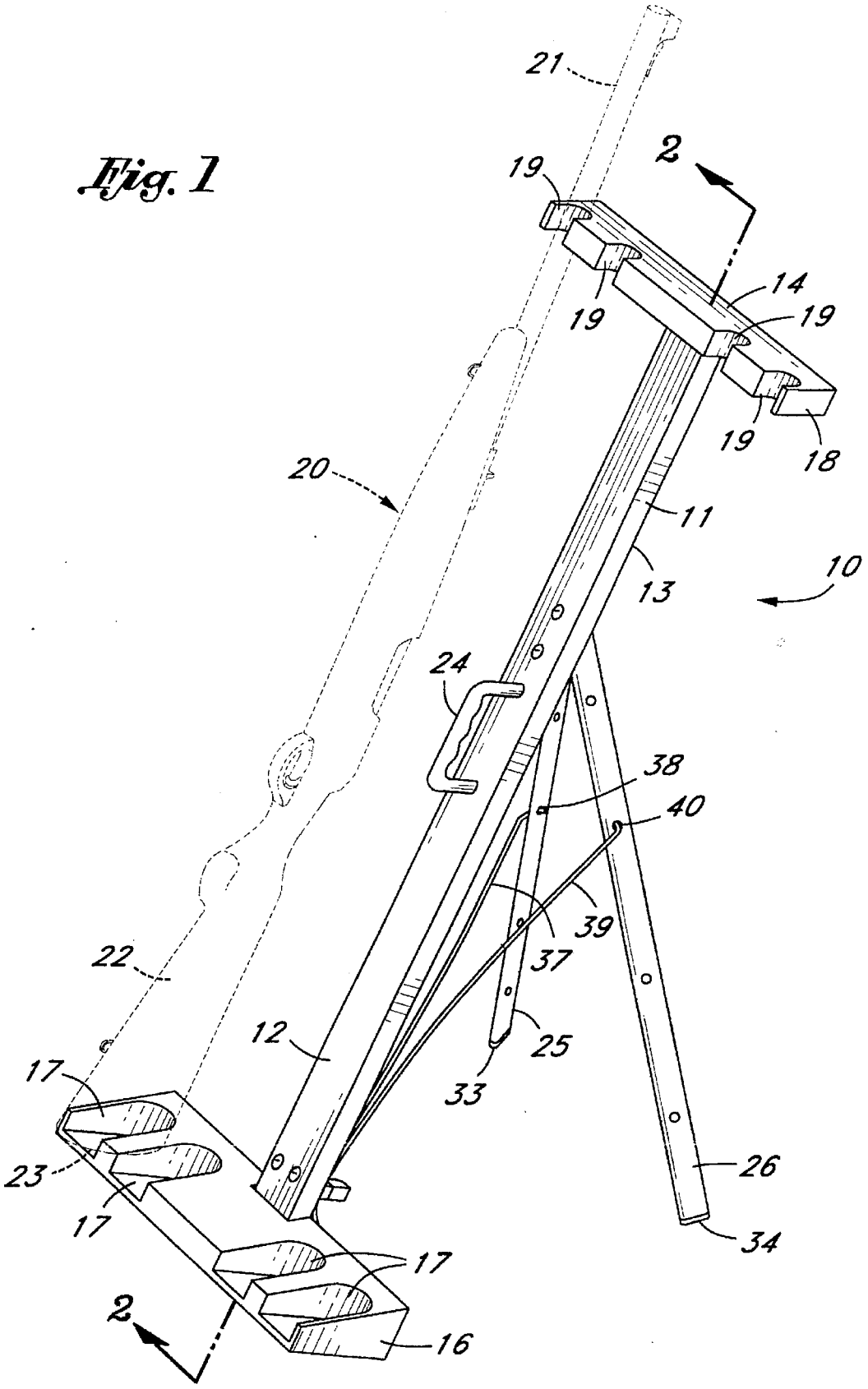
FIG. 1 is a perspective view showing the front, right side and top of the portable gun rack of the present invention.

The gun rack of the present invention is shown in an open or free-standing position in FIG. 1 and indicated generally by reference character 10. Gun rack 10 has an elongated rack frame 11 which has a front 12 and a rear 13, a top 14 and a bottom 15. Bottom 15 is shown in FIG. 2.

Gun rack 10 has a butt support shelf 16 with four shaped recesses 17. A barrel support arm 18 has four barrel support recesses 19. A firearm 20 has a barrel 21, a stock 22 with a butt 23. Butt 23 is held in one of the shaped recesses 17. Barrel 21 rests in one of the barrel support recesses 19. In this way, the firearm 20 can be readily carried by holding handle 24 and yet may be easily rested in the gun rack as it is in a standing position such as that shown in FIG. 1.

Figure 5:
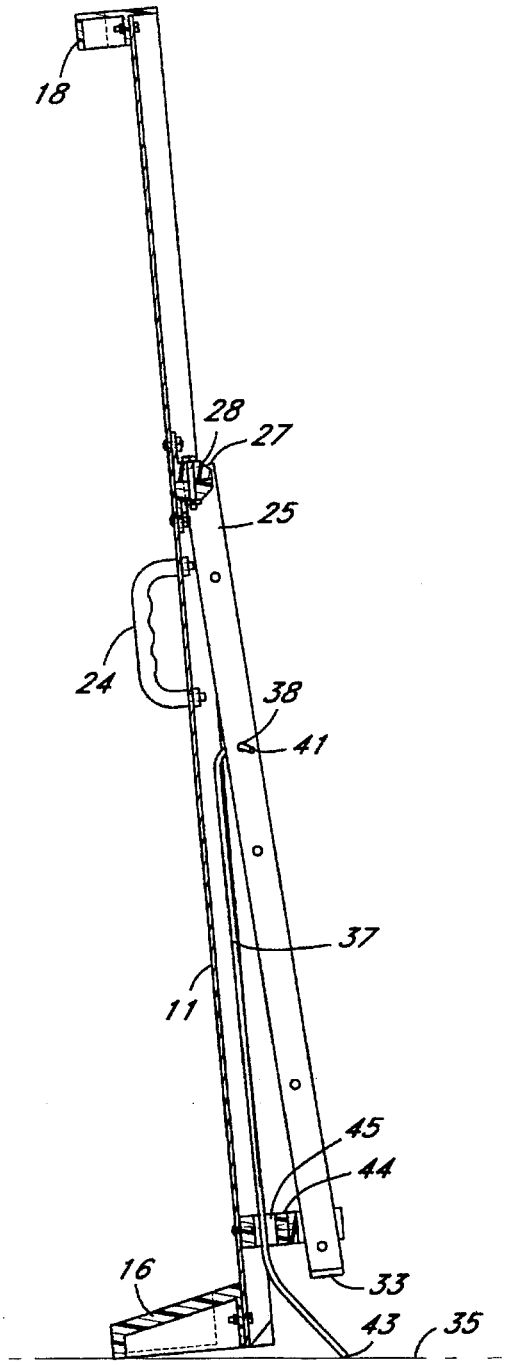
FIG. 5 is a cross-sectional side view of the gun rack of FIG. 1 with its legs in a closed configuration.
Figure 6:
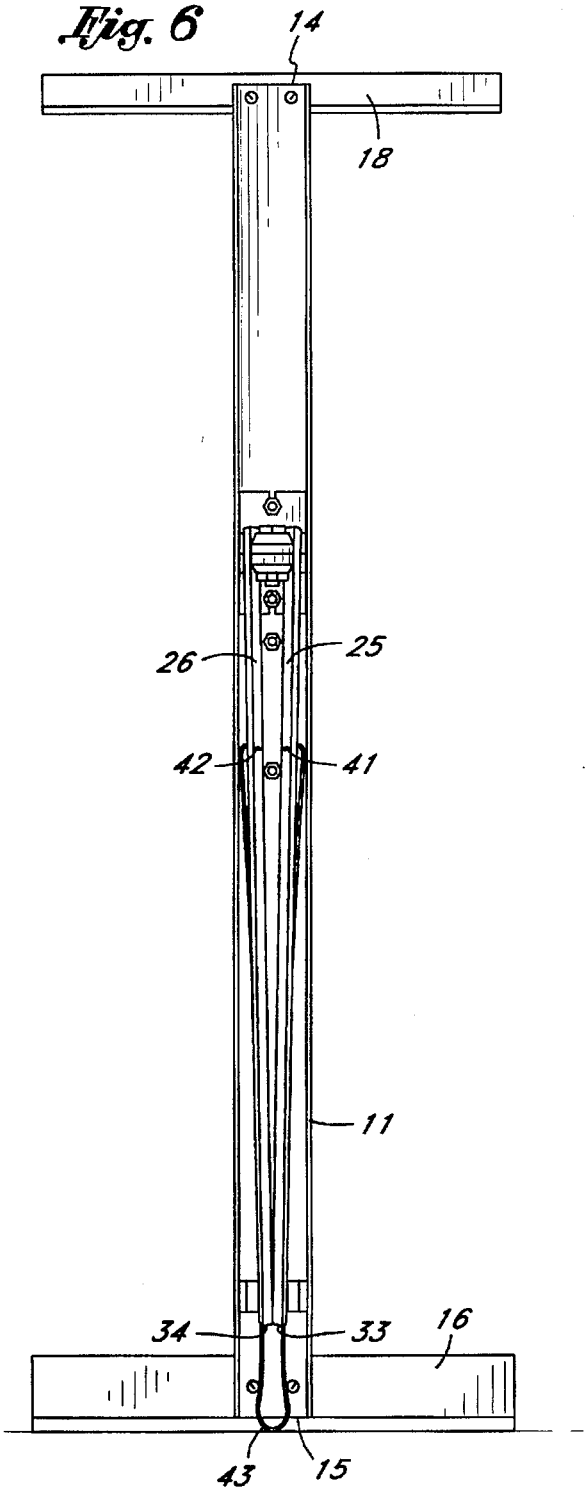
FIG. 6 is a rear view of the gun rack of FIG. 1 with the legs in a closed configuration.

The gun rack 10 is caused to be free-standing by its support on butt support shelf 16 and on first leg 25 and second leg 26. As shown best in FIGS. 2, 3 and 4, the leg such as leg 26 is pivotally held at its pivoted end 27 in a hinged piece 28. Hinged piece 28 has a pair of slots 29 and 30. A pivot pin 31 is positioned across slot 29 and pivotally holds first leg 25. Similarly, pivot pin 32 is held across slot 30 and pivotally holds second leg 26. First leg 25 has a foot 33 and second leg 26 has a foot 34 which contacts the ground as shown in FIG. 2. A leg actuating means, generally indicated by reference character 36, is a U-shaped length of spring steel which has a first arm 37 pivotally connected at 38 to first leg 25. Second arm 39 is pivotally connected at 40 to second leg 26. Leg actuating means 36 is generally U-shaped and when in a relaxed configuration similar to that shown in FIG. 6, has its first terminus 41 passed through an opening at 38 in leg 25 and its second upper terminus 42 also is passed through an opening at 40 in second leg 26. The base of the U-shaped member comprises a foot 43 shown best in FIGS. 2, 5 and 6. Foot 43 contacts the ground as shown in FIG. 5 and urges first arm 37 and second arm 39 upwardly which moves first leg 25 and second leg 26 outwardly to the position shown in FIG. 1. The U-shaped leg actuating means 36 is held in a guide channel member 44 and passes through an opening 45 therein shown best in FIG. 4, but also shown in FIG. 5. This permits the leg actuating means 36 to move upwardly and downwardly in guide channel member 44, but retains it close to frame 11. Because the first and second arm are biased toward a closed position when the portable gun rack is lifted by its carrying handle 24 the biasing action tends to close the first and second legs together to the closed position shown in FIG. 5 and 6. Thus, the device is easily converted to a compact closed configuration when lifted.

It is preferred that the rack carry at least two guns and four is the preferred number. In this way a compact and easily transported rack may be constructed which allows the sportsman to readily carry his firearms and yet, retain them in a clean and safe position when not in use. While the U-shaped leg actuating means 36 provides a particularly efficient way of actuating the opening of the legs, many other leg actuating mechanism's are known which also can be used in place of that shown. The important feature is the positioning of the leg actuating means on the rear of a gun rack.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A portable gun rack for transporting and supporting at least one firearm of the type having an elongated barrel and a stock having a butt, said rack comprising:

an elongated rack frame having a top and a bottom, a front and a rear;

a butt support shelf held near the bottom of said elongated rack frame, said butt support shelf having at least one shaped recess for holding a butt of a firearm;

a barrel support arm held near the top of said elongated rack frame, said barrel support arm having at least one barrel support recess;

a first and a second leg each leg being pivotally held at a pivot point to said elongated rack frame between said barrel support arm and said butt support shelf, each leg having a pivoted end pivotally attached to said elongated rack frame and a foot, each leg being movable from a closed position wherein it lies against said elongated rack frame to an open position wherein it is pivoted away from the elongated rack frame and the foot of the first leg being moved away from the foot of the second leg; and leg actuating means comprising a first arm affixed to said first leg between its pivoted end and its foot and a second arm affixed to said second leg between its pivoted end and its foot and said first arm and said second arm being connected to an actuating foot which touches the ground when said gun rack is placed with its butt support shelf adjacent the ground and moves said first arm and said second arm upwardly along said frame thus pivoting the feet of said first and second leg away from said frame to an open position and said leg actuating means including biasing means so that when said gun rack is lifted upwardly from the ground, the first and second legs move to a closed position.

2. The portable gun rack of claim 1 wherein said leg actuating means is a single length of spring steel having been formed into an elongated U shape with first and second upper ends being affixed to the first and second legs respectively and a base comprising an actuating foot and said single length of spring steel being captured in an opening of a guide member held to the frame near the bottom thereof.

3. The portable gun rack of claim 1 wherein said butt support shelf has four shaped recesses and said barrel support arm has four barrel support recesses.

4. The portable gun rack of claim 1 further including a handle affixed to the front of the frame midway between the top and the bottom of the frame.

5. A portable gun rack for carrying and supporting in a free standing position a plurality of guns, said run rack comprising:

an elongated frame having a top and a bottom, a front and a back;

a butt support shelf affixed adjacent the bottom of the elongated frame and the butt support shelf having at least two shaped recesses for supporting the butt of a gun to be held therein;

a barrel support arm affixed adjacent the top of the elongated frame, said barrel support arm having at least two barrel support openings;

a handle affixed to the front of said frame generally midway between said butt support shelf and said barrel support arm;

a first leg pivotally affixed to the rear of said frame and movable from a closed position adjacent to said frame and an open position angled rearwardly from said frame said first leg having a foot at a lower end thereof;

a second leg pivotally affixed to the rear of said frame and movable from a closed position adjacent to said frame and an open position angled rearwardly from said frame said second leg having a foot at a lower end thereof; and leg control means including a first arm connected to said first leg at an upper end of said first arm and a second arm connected to said second leg at an upper end of said second arm and said first and second arms being interconnected near a lower end of said first and second arms and said first and second arms being slidably held near said frame by a guide member and said first and second arms being affixed to an actuating foot below said guide member, said actuating foot being positioned so that it contacts the ground when the portable gun rack is lowered so that its butt support shelf contacts the ground and when it contacts the ground, the actuating foot moves the first and second arm upwardly along said elongated frame thus causing the first and second legs to pivot away from the frame.

6. The portable gun rack of claim 5 further including biasing means urging the first and second legs into a closed position.

7. The portable gun rack of claim 6 wherein said leg actuating means is a U shaped member formed from spring steel having a first and a second terminus and having a U shaped base comprising an actuating foot and said U shaped member having its first and second terminus adjacent one another when in a relaxed configuration and said U shaped member being bent away from the frame near the U shaped base.

* * * * *